US012624707B2

(12) United States Patent
Anbazhagan et al.

(10) Patent No.: US 12,624,707 B2
(45) Date of Patent: May 12, 2026

(54) FLUID COMPRESSOR HAVING BLOW-BY FLOW FOR JOURNAL BEARING COOLING

(71) Applicant: Garrett Transportation I Inc., Torrance, CA (US)

(72) Inventors: Vijaysarathy Anbazhagan, Bangalore (IN); Darius Mehta, Rancho Palos Verdes, CA (US); Gururaj Jk, Bangalore (IN); Suryakant Gupta, Bangalore (IN); Kosuvari Vamsikrishna Reddy, Bangalore (IN); Aniket Santoshwar, Bangalore (IN)

(73) Assignee: Garrett Transportation I Inc, Torrance, CA (US)

( * ) Notice: Subject to any disclaimer, the term of this patent is extended or adjusted under 35 U.S.C. 154(b) by 83 days.

(21) Appl. No.: 18/422,041

(22) Filed: Jan. 25, 2024

(65) Prior Publication Data

US 2025/0243877 A1 Jul. 31, 2025

(51) Int. Cl.

| | |
|---|---|
| ***F04D 29/58*** | (2006.01) |
| ***F04D 17/10*** | (2006.01) |
| ***F04D 25/06*** | (2006.01) |
| ***F04D 29/056*** | (2006.01) |

(52) U.S. Cl.

CPC ..... *F04D 29/582* (2013.01); *F04D 17/10* (2013.01); *F04D 25/06* (2013.01); *F04D 29/056* (2013.01)

(58) Field of Classification Search

CPC .. F04D 29/5806; F04D 29/053; F04D 29/056; F04D 29/284; F04D 29/5826; F04D 25/0606; F04D 29/584; F04D 29/051

See application file for complete search history.

(56) References Cited

FOREIGN PATENT DOCUMENTS

JP 2013024079 A * 2/2013

OTHER PUBLICATIONS

JP-2013024079-A English Translation (Year: 2013).*

* cited by examiner

*Primary Examiner* — Anthony Ayala Delgado
(74) *Attorney, Agent, or Firm* — BelayIP

(57) ABSTRACT

An electric motor-powered centrifugal compressor having serially connected low- and high-pressure stages includes journal bearings for the shaft of the compressor, the journal bearings being contained in a motor housing that defines a motor cavity enclosing the electric motor. A labyrinth seal is arranged between the high-pressure compressor wheel and the adjacent journal bearing. The labyrinth seal allows a metered flow of fluid, constituting a fraction of the main fluid flow, to pass the labyrinth seal and flow through the journal bearing into the motor cavity for cooling the journal bearing.

17 Claims, 4 Drawing Sheets

FLUID COMPRESSOR HAVING BLOW-BY FLOW FOR JOURNAL BEARING COOLING

BACKGROUND OF THE INVENTION

This application relates generally to turbomachinery, and relates more particularly to high-pressure compressors of the centrifugal type.

High-pressure compressors are used in a variety of applications, such as industrial air compressors, fuel cell compressors, refrigerant compressors, and the like. Typically, multi-stage arrangements are employed in order to achieve the required high pressure ratio. A common architecture, for example, is a serially connected pair of serial two-stage compressors, yielding a four-stage compression process. The journal bearing adjacent the stage-4 compressor is at particular risk of overheating because of the relatively low levels of cooling flow typically available in such compressors, combined with the relatively high temperature of the fluid within the stage-4 compressor.

SUMMARY OF THE DISCLOSURE

The present disclosure describes embodiments of compressors defining a journal bearing cooling flow path that facilitates effective cooling of the journal bearing via blow-by flow.

In accordance with one embodiment described herein, a compressor comprises:

- a high-pressure compressor comprising a shaft, a centrifugal high-pressure compressor wheel affixed to one end of the shaft, and a high-pressure compressor housing enclosing the high-pressure compressor wheel;
- a motor housing affixed to the high-pressure compressor housing and containing a high-pressure journal bearing for the shaft;
- a labyrinth seal disposed between the high-pressure compressor wheel and the high-pressure journal bearing;
- an electric motor contained in a motor cavity of the motor housing; and
- a journal bearing cooling flow path extending axially past the labyrinth seal and through the high-pressure journal bearing into the motor cavity.

The side of the labyrinth seal closer to the high-pressure compressor wheel is in fluid communication with the high-pressure fluid at the exit of the wheel. A fraction of such high-pressure fluid (i.e., the "bleed portion") flows radially inwardly along the back disk of the wheel into the space adjacent to the labyrinth seal. The pressure on the opposite side of the labyrinth seal closer to the motor cavity is relatively lower in pressure, and the bleed portion of the fluid, also referred to herein as the "blow-by flow," passes through the labyrinth seal. The labyrinth seal is effectively a metering device that governs the flow split between the blow-by flow and the main flow of fluid exiting the high-pressure compressor wheel. After passing through the labyrinth seal, the blow-by flow proceeds through the high-pressure journal bearing into the motor cavity, thereby cooling the journal bearing.

In one embodiment, the compressor further comprises a low-pressure compressor in series with the high-pressure compressor, and an interstage cooler arranged between the low-pressure compressor and the high-pressure compressor. Cooling of the fluid coming out of the low-pressure compressor prior to entering the high-pressure compressor is effective to further improve the cooling of the high-pressure journal bearing.

The invention also provides a method for providing cooling flow in a high-pressure compressor of a compressor, the high-pressure compressor comprising a shaft, a centrifugal high-pressure compressor wheel affixed to one end of the shaft, and a high-pressure compressor housing enclosing the high-pressure compressor wheel, the compressor further comprising a motor housing affixed to the high-pressure compressor housing, the motor housing defining a motor cavity and containing a high-pressure journal bearing for the shaft. The method comprises:

- operating the high-pressure compressor to compress a fluid;
- producing a metered cooling flow by bleeding and metering a fraction of the fluid from an exit of the high-pressure compressor stage using a labyrinth seal disposed between the high-pressure compressor wheel and the high-pressure journal bearing; and
- passing the metered cooling flow through the high-pressure journal bearing and into the motor cavity.

The compressor can comprise a two-stage compressor having a low-pressure compressor arranged in series with the high-pressure compressor. The method accordingly can further comprise:

- operating the low-pressure compressor to the fluid; and
- cooling the fluid discharged from the low-pressure compressor prior to the fluid entering the high-pressure compressor.

BRIEF DESCRIPTION OF THE DRAWINGS

Having described the present disclosure in general terms, reference will now be made to the accompanying drawing (s), which are not necessarily drawn to scale, and wherein.

DETAILED DESCRIPTION OF THE DRAWINGS

The present disclosure will now be described in fuller detail with reference to the above-described drawings, which depict some but not all embodiments of the invention (s) to which the present disclosure pertains. These inventions may be embodied in various forms, including forms not expressly described herein, and should not be construed as limited to the particular exemplary embodiments described herein. In the following description, like numbers refer to like elements throughout.

Figure 1:
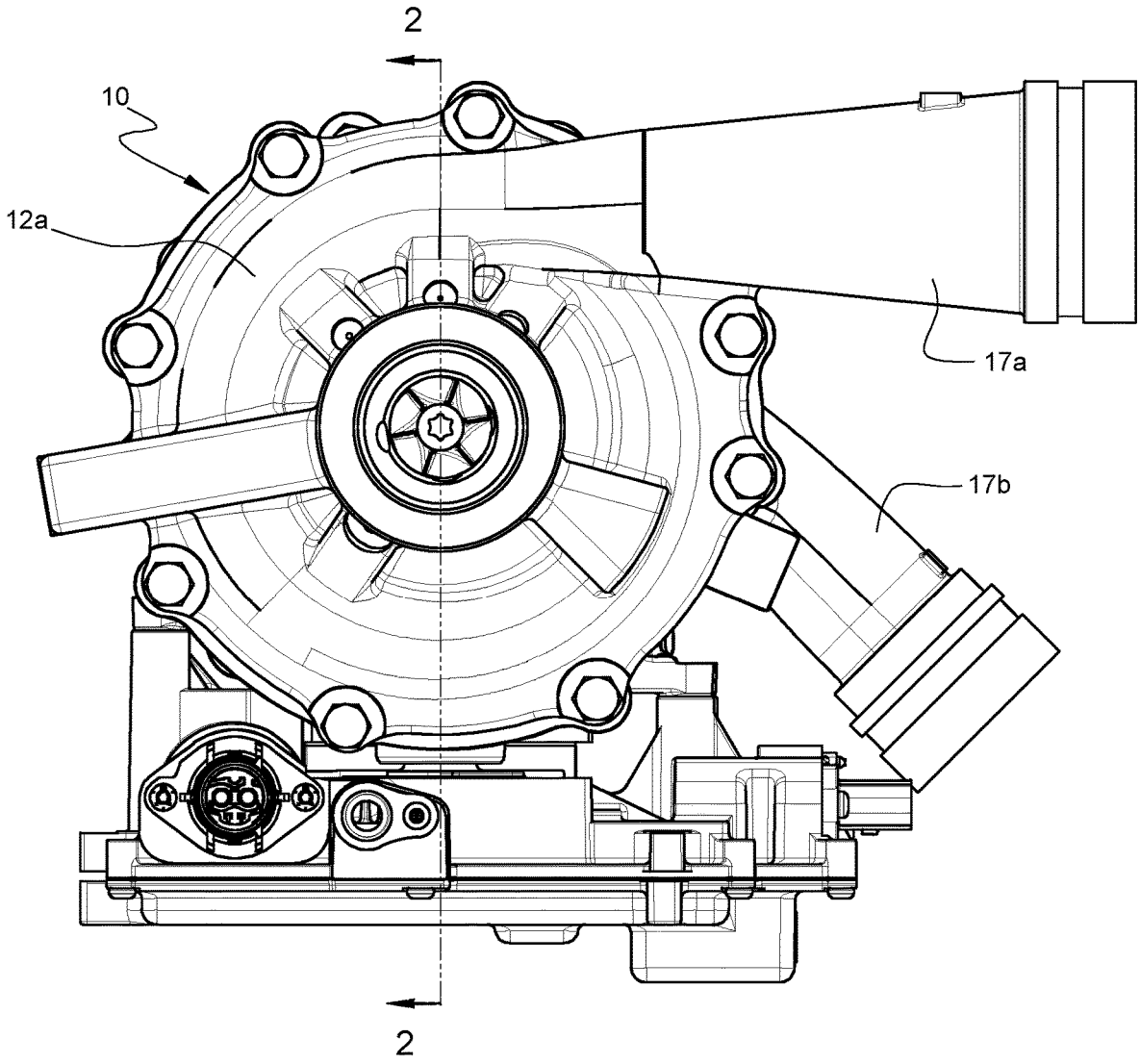
FIG. 1 is an axial end view of an electric motor-powered compressor in accordance with one embodiment of the invention.
Figure 2:
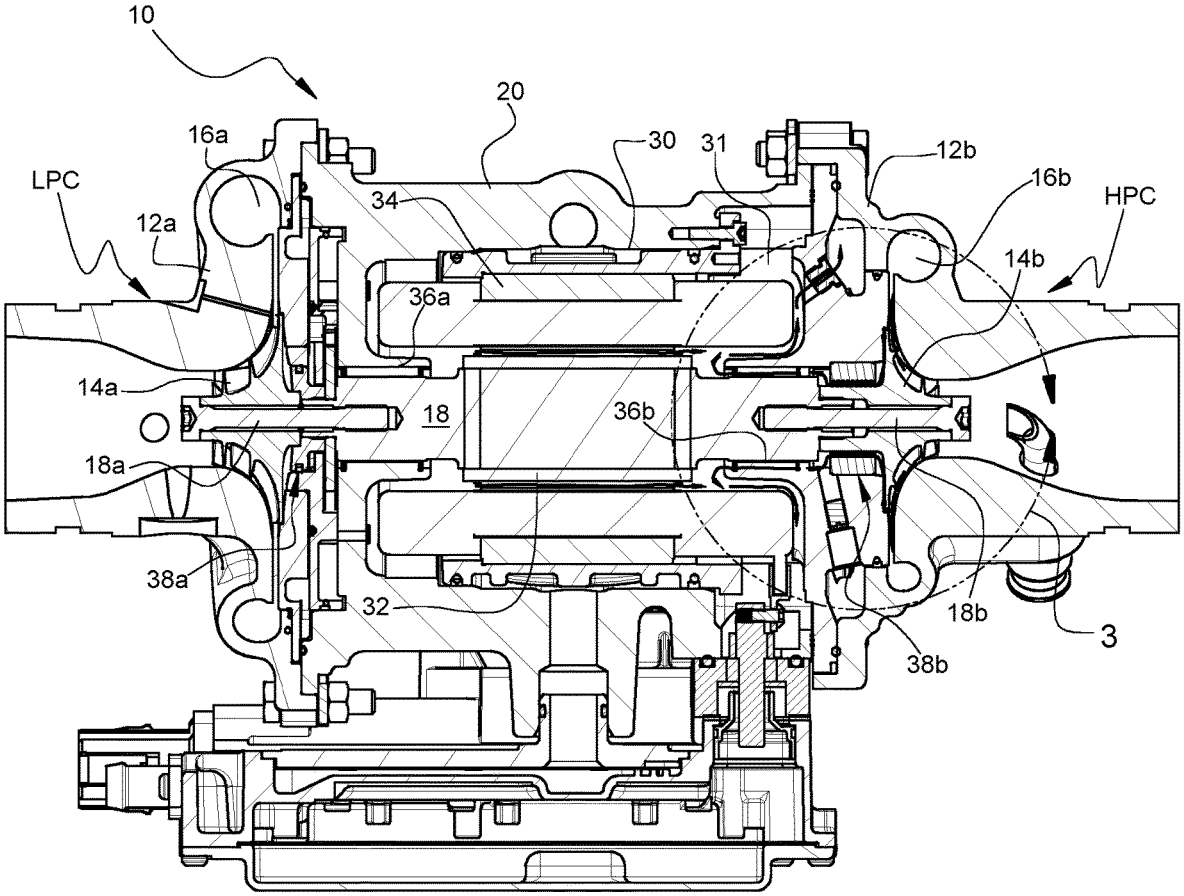
FIG. 2 is a cross-sectional view along line 2-2 in FIG. 1.
Figure 3:
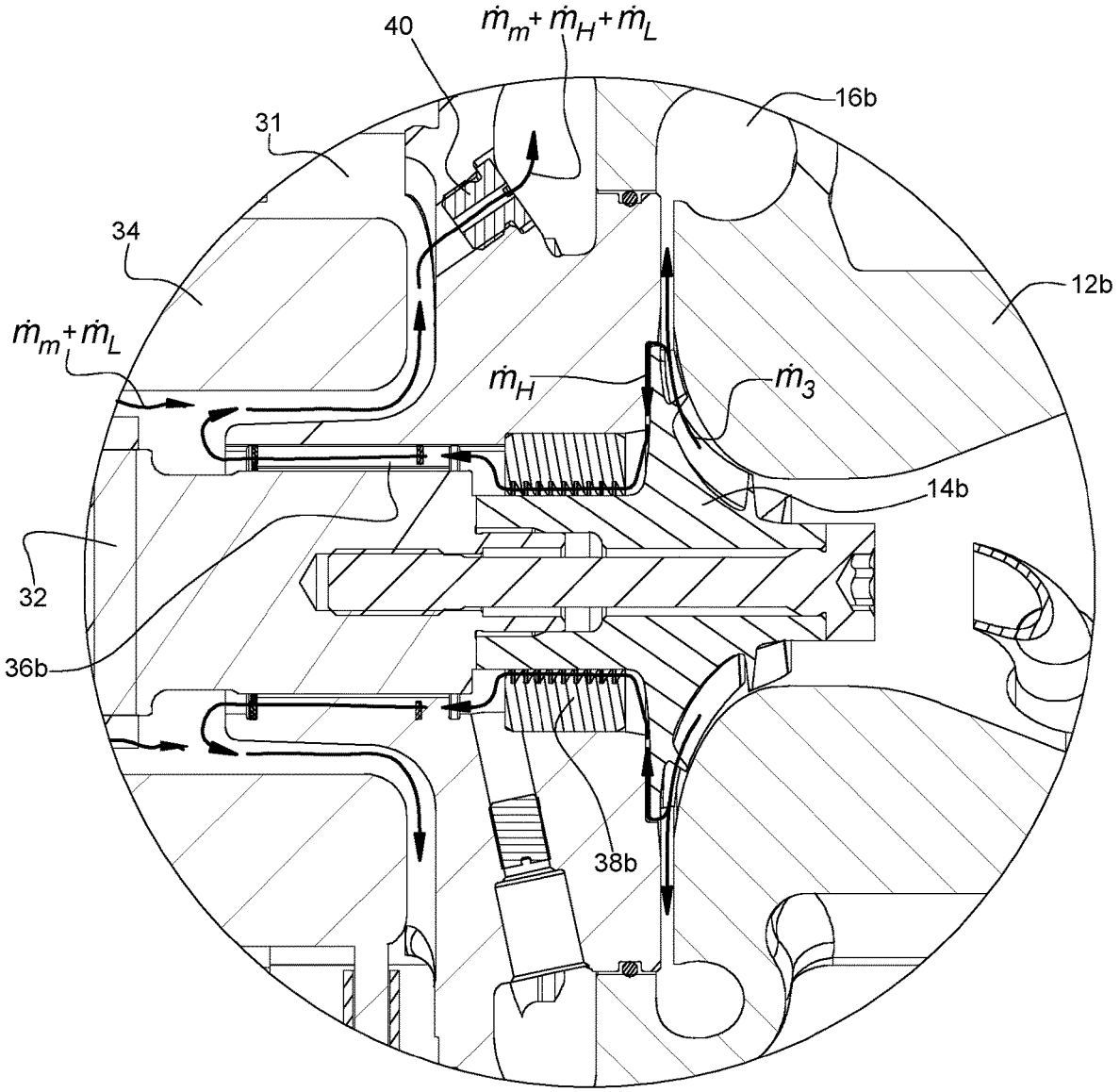
FIG. 3 is a magnified view of a portion of FIG. 2, showing details of the cooling flow path for the high-pressure journal bearing.

FIGS. 1 through 3 depict a serial two-stage compressor 10 in accordance with one embodiment of the invention. The compressor comprises a low-pressure compressor LPC comprising a low-pressure compressor housing 12*a* containing a low-pressure compressor wheel 14*a* affixed to a shaft 18*a*. The low-pressure compressor housing defines a main flow path for fluid to enter the wheel 14*a* along an axial direction. The wheel compresses the fluid while turning the flow to proceed radially outwardly at an exit of the wheel. The fluid passes through a diffuser and is collected in a low-pressure volute 16*a* defined by the housing. A low-pressure discharge conduit 17*a* leads the fluid out from the low-pressure stage, whereupon the fluid is fed into the high-pressure compressor stage for further compression.

The high-pressure compressor HPC comprises a high-pressure compressor housing 12*b* containing a high-pressure compressor wheel 14*b* affixed to a shaft 18*b*. The high-pressure compressor housing defines a main flow path for fluid to enter the wheel 14*b* along an axial direction. The wheel compresses the fluid while turning the flow to proceed radially outwardly at an exit of the wheel. The fluid passes through a diffuser and is collected in a high-pressure volute 16*b* defined by the housing. A high-pressure discharge conduit 17*b* leads the fluid out from the high-pressure stage for delivery to the component or system requiring pressurized fluid.

The compressor 10 further comprises an electric motor 30 contained in a cavity 31 of a motor housing 20. The motor housing is disposed between and affixed to the low-pressure housing 12*a* and the high-pressure housing 12*b*. The motor comprises a rotor 32 and a stator 34. The rotor is affixed to the shafts 18*a* and 18*b* for the low- and high-pressure compressor wheels, such that the rotor and two shafts essentially constitute a unitary shaft 18 for the machine.

The shaft 18 is rotatably supported by a low-pressure journal bearing 36*a* adjacent the low-pressure compressor wheel 14*a* and a high-pressure journal bearing 36*b* adjacent the high-pressure compressor wheel. The journal bearings are in fluid communication with the motor cavity 31 and are fluidly isolated from the main fluid flows in the low- and high-pressure compressor stages by shaft seals 38*a* and 38*b*, respectively.

In accordance with an embodiment of the invention, the high-pressure shaft seal 38*b* comprises a labyrinth seal, as best seen in FIG. 3. The labyrinth seal is structured and arranged to allow a small amount of the main fluid flow $\dot{m}_3$ to pass through or "blow by" the seal; this blow-by flow is designated mu in FIG. 3. After passing through the labyrinth seal, the blow-by flow then flows through the journal bearing 36*b* to cool it, and then is received into the motor cavity 31, where it joins with the motor-cooling fluid $\dot{m}_m$ that is separately supplied for cooling the motor, plus the low-pressure journal bearing cooling flow $\dot{m}_L$ that is bled from the main flow passing through the low-pressure compressor. The combined cooling flows are removed from the motor housing via an exit orifice plug 40 and are recirculated back to the inlet to the low-pressure compressor.

Figure 4:
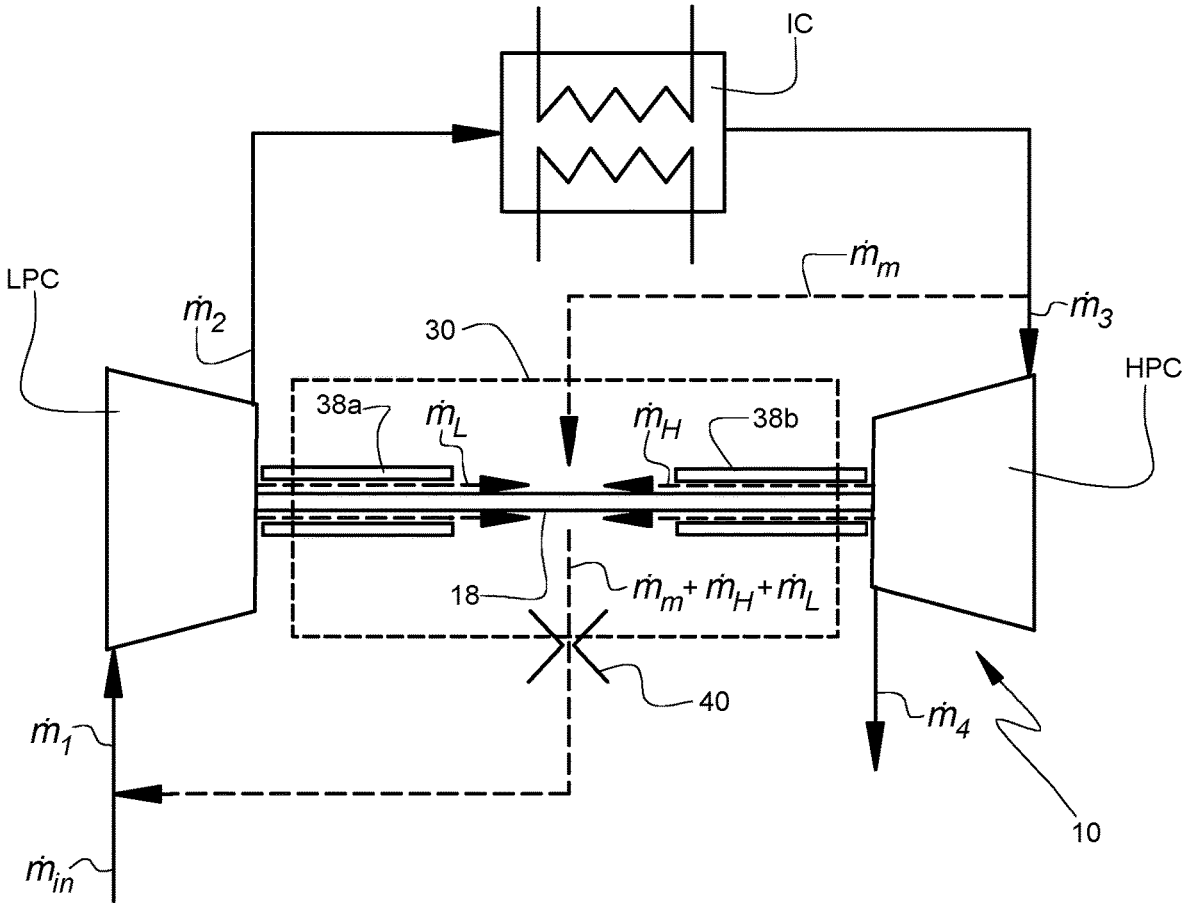
FIG. 4 is a schematic view of a system employing the compressor of FIG. 2 coupled with an interstage cooler, and illustrating the cooling flow paths for the journal bearings and motor of the compressor.

FIG. 4 is a schematic illustration of a compressor arrangement in accordance with an embodiment of the invention. The arrangement includes the compressor 10 comprising a low-pressure compressor LPC and a high-pressure compressor HPC connected in series, with journal bearings 38*a* and 38*b* for the shaft 18, and a motor 30. The arrangement further comprises an intercooler IC comprising a heat exchanger. The fluid discharged from the low-pressure compressor is passed through the intercooler, where it is cooled by heat exchange with a cooling fluid, before it is fed into the inlet to the high-pressure compressor. The following relationships apply to the various mass flow rates within the arrangement of FIG. 4:

$$\dot{m}_1(\text{LPC inlet flow rate})=\dot{m}_{in}+\dot{m}_m+\dot{m}_H+\dot{m}_L$$

$$\dot{m}_2(\text{LPC outlet flow rate})=\dot{m}_1-\dot{m}_L$$

$$\dot{m}_3(\text{HPC inlet flow rate})=\dot{m}_2-\dot{m}_m$$

$$\dot{m}_4(\text{HPC outlet flow rate})=\dot{m}_3-\dot{m}_H=\dot{m}_{in}$$

The journal bearing cooling scheme in accordance with the invention can mitigate some of the drawbacks of certain conventional cooling schemes in which the high-pressure journal bearing cooling flow comes from the motor cavity after having passed through and cooled the motor stator, and proceeds through the journal bearing in the opposite direction (left-to-right in FIG. 3). In that conventional cooling scheme, the cooling flow for the high-pressure journal bearing has a high inlet temperature because of the heat exchange with the motor stator, and therefore the cooling flow rate must be relatively high in order to provide sufficient cooling to the bearing, resulting in degradation of compressor performance. Additionally, the conventional scheme leads to a relatively high thrust load on the high-pressure compressor wheel because of the relatively low pressure existing in the space between the wheel and the journal bearing.

In contrast, in accordance with the invention, the cooling flow for the high-pressure journal bearing has a relatively lower inlet temperature because it has not first picked up heat from the motor stator as in the conventional scheme. Even after cooling the journal bearing, the blow-by flow has a lower temperature than the motor cooling flow, and the blow-by cooling flow blows on the stator end windings, providing more-effective cooling and lower temperature of the end windings compared with the conventional scheme.

Additionally, the use of the intercooler between the low-pressure and high-pressure compressors further reduces the inlet temperature to the journal bearing. The lower bearing inlet temperature allows the cooling flow rate for the journal bearing to be reduced relative to the conventional scheme, thereby reducing the cooling flow's impact on compressor performance. A further benefit to compressor performance is attained by reducing the motor cooling flow rate, which is made possible by the fact that the motor cooling flow no longer needs to cool the journal bearing.

Furthermore, the cooling scheme of the invention leads to a relatively higher pressure at the back side of the high-pressure compressor wheel, and therefore relatively lower thrust load on the wheel than for the conventional scheme.

Persons skilled in the art, on the basis of the present disclosure, will recognize that modifications and other embodiments of the inventions described herein can be made without departing from the inventive concepts described herein. Specific terms used herein are employed for explanatory purposes rather than purposes of limitation. Accordingly, the inventions are not to be limited to the specific embodiments disclosed, and modifications and other embodiments are intended to be included within the scope of the appended claims.

What is claimed is:

1. A compressor, comprising:

a high-pressure compressor comprising a shaft, a centrifugal high-pressure compressor wheel affixed to one end of the shaft, and a high-pressure compressor housing enclosing the high-pressure compressor wheel;

a motor housing affixed to the high-pressure compressor housing and containing a high-pressure journal bearing for the shaft;

a labyrinth seal disposed between the high-pressure compressor wheel and the high-pressure journal bearing;

an electric motor contained in a motor cavity of the motor housing;

a journal bearing cooling flow path extending axially past the labyrinth seal and through the high-pressure journal bearing into the motor cavity; and wherein the labyrinth s meters blow-by flow of compressed fluid, and wherein said blow-by flow passes the high-pressure journal bearing into the motor cavity to cool the journal bearing.

2. The compressor of claim 1, further comprising a low-pressure compressor in series with the high-pressure compressor.

3. The compressor of claim 2, further comprising an interstage cooler arranged between the low-pressure compressor and the high-pressure compressor.

4. The compressor of claim 1, wherein the motor cavity includes an outlet conduit configured to recirculate the blow-by flow from the motor cavity back to an inlet of the low-pressure compressor.

5. The compressor of claim 1, wherein the labyrinth seal is configured to meter the blow-by flow at a rate less than 5% of the main flow exiting the high-pressure compressor wheel.

6. The compressor of claim 1, further comprising a temperature sensor disposed adjacent the high-pressure journal bearing and configured to monitor bearing temperature as the blow-by flow cools the bearing.

7. The compressor of claim 1, further comprising an intercooler arranged between the low-pressure compressor and the high-pressure compressor, the intercooler configured to reduce the temperature of the blow-by flow entering the journal bearing.

8. The compressor of claim 1, wherein the motor cavity is configured such that the blow-by flow, after passing through the high-pressure journal bearing, impinges on end windings of the motor to cool the motor windings.

9. A method for providing cooling flow in a high-pressure compressor of a compressor, the high-pressure compressor comprising a shaft, a centrifugal high-pressure compressor wheel affixed to one end of the shaft, and a high-pressure compressor housing enclosing the high-pressure compressor wheel, the compressor further comprising a motor housing affixed to the high-pressure compressor housing, the motor housing defining a motor cavity and containing a high-pressure journal bearing for the shaft, the method comprising:

operating the high-pressure compressor to compress a fluid;

producing a metered cooling flow by bleeding and metering a fraction of the fluid from an exit of the high-pressure compressor stage using a labyrinth seal disposed between the high-pressure compressor wheel and the high-pressure journal bearing; and passing the metered cooling flow through the high-pressure journal bearing and into the motor cavity, and wherein the labyrinth seal meters a blow-by flow of compressed fluid, and wherein said blow, by flow passes through the high-pressure journal bearing into the motor cavity to cool the journal bearing.

10. The method of claim 9, wherein the compressor comprises a two-stage compressor having a low-pressure compressor arranged in series with the high-pressure compressor, the method further comprising:

operating the low-pressure compressor to the fluid; and cooling the fluid discharged from the low-pressure compressor prior to the fluid entering the high-pressure compressor.

11. The method of claim 9, further comprising discharging the blow-by flow from the motor cavity and recirculating the discharged flow to an inlet of a low-pressure compressor stage.

12. The method of claim 9, wherein the labyrinth seal meters the blow-by flow at a mass flow rate less than 5% of the high-pressure compressor discharge flow.

13. The method of claim 9, further comprising sensing a temperature of the high-pressure journal bearing and controlling the blow-by flow in response to the sensed temperature.

14. The method of claim 9, further comprising intercooling fluid discharged from a low-pressure compressor prior to entry into the high-pressure compressor, thereby reducing the temperature of the blow-by flow cooling the journal bearing.

15. The method of claim 9, further comprising directing the blow-by flow, after passage through the journal bearing, to cool end windings of the motor.

16. The method of claim 9, wherein the blow-by flow and a motor cooling flow are combined within the motor cavity and exhausted through a common outlet.

17. The method of claim 9, further comprising metering the blow-by flow by varying a clearance of the labyrinth seal.

* * * * *